United States Patent [19]

Mintz

[11] 4,024,929

[45] May 24, 1977

[54] LADDER

[76] Inventor: Daniel Mintz, Pembroke Station, Unit A, F.C.I., Danbury, Conn. 06810

[22] Filed: Nov. 18, 1974

[21] Appl. No.: 524,622

[52] U.S. Cl. ..... 182/151; 182/178; 182/228

[51] Int. Cl.[2] ..... E06C 1/10; E06C 7/50

[58] Field of Search ..... 182/194, 228, 178, 107, 182/24, 151

[56] References Cited

UNITED STATES PATENTS

| | | | |
|---|---|---|---|
| 1,473,228 | 11/1923 | Grundel | 182/178 |
| 1,520,414 | 12/1924 | Hamilton | 182/228 |
| 3,139,949 | 7/1964 | Graves | 182/164 |
| 3,268,031 | 8/1966 | Hampson | 182/228 |
| 3,476,211 | 11/1969 | Cormier | 182/178 |

FOREIGN PATENTS OR APPLICATIONS

| | | | |
|---|---|---|---|
| 164,308 | 10/1949 | Austria | 182/194 |

*Primary Examiner*—Reinaldo P. Machado

[57] ABSTRACT

A portable ladder comprising a plurality of similar interfitting rail units which are modular in nature to facilitate assembly and disassembly of a ladder of any desired height. A plurality of similar rung units interfit with and interlock upon the rail units at spaced intervals to form a complete ladder construction.

7 Claims, 4 Drawing Figures

LADDER

BACKGROUND OF THE INVENTION

This invention relates generally to the field of ladder construction, and more particularly, is directed to a portable, knock-down type of ladder comprising a plurality of modular, interfitting parts.

Ladders, by their very nature and design, tend to be cumbersome in handling and in transportation due to the ungainly length and weight normally associated with ladder constructions. Because of the elongated nature of ladders, workers and others who normally utilize ladders and find it necessary to transport them from one place to another generally have found it necessary to provide special fixtures. such as racks and roof carriers and other devices to render a vehicle suitable for ladder transportation. In this regard, motor vehicles have generally been fitted with specially designed roof type carriers to thereby allow a worker to tie the ladder exteriorly of the vechicle during transportation of a ladder from job to job. In the event that the ladder was of a height greater than the length of a vehicle, sometimes it was found that a desired vehicle could not safely be employed to transport the ladder.

Prior workers in the field have attempted to provide solutions to such problems by designing modular or knock-down types of ladder constructions to facilitate ladder transportation and ladder erection procedures. U.S. Pat. Nos. 3,703,939, 1,473,228 and 3,476,221 are exemplary of such prior art types of knock-down ladders.

SUMMARY OF THE INVENTION

The present invention relates generally to the field of portable ladder constructions and more particularly, is directed to a knock-down, modular, sectional, portable ladder construction which may be readily assembled and disassembled and which may be easily transported in the knock-down mode.

The present invention includes a pllurality of similar, modular, interlocking rail sections each of which is provided with a socket recess at one end and a projecting strut at the other end to facilitate a rigid, interlocking, easily assembled and dissassembled and extremely sturdy rail construction. A suitable number of modular rail sections are fitted together to form a ladder of any desired length to reach the necessary working height. A plurality of similar, modular rung sections are provided with end interlocking construction to lock upon notches formed in the rail sections to form a plurality of vertically spaced, sturdy rungs to support the weight of a worker. Preferably, simple latching mechanisms are provided to lock the parts after assembly and to prevent unintentional dissassembly of the various modular sections.

It is an object of the present invention to provide an improved, novel, portable ladder of the type set forth.

It is another object of the present invention to provide a novel portable ladder including a plurality of similar, modular, interfitting rail sections which may be readily assembled and disassembled to form a ladder of any desired length.

It is another object of the present invention to provide a novel portable ladder including a plurality of modular rail sections, each of which is similarly formed and each of which includes a longitudinally extending recess at one end and a projecting strut at the other end of suitable dimensions and strength to facilitate longitudinally interlocking juxtaposed modular sections.

It is another object of the present invention to provide a novel portable ladder including a plurality of similar, modular rail sections, means to longitudinally interconnect the rail sections and including means to mount a plurality of vertically spaced interlocking rung sections to form a ladder of any desired length.

It is another object of the present invention to provide a novel portable ladder including a plurality of similar, modular rail units, connecting means associated with each rail unit to facilitate end to end assembly thereof, each modular rail unit including a notched section featuring rung interlock construction and a plurality of similar, modular rung sections provided with connecting means to join to the rail sections in easily assembled and disassembled junctions.

It is another object of the present invention to provide a portable ladder that is simple in design, rugged in construction and inexpensive in manufacture.

Other objects and a fuller understanding of the invention will be had by referrring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
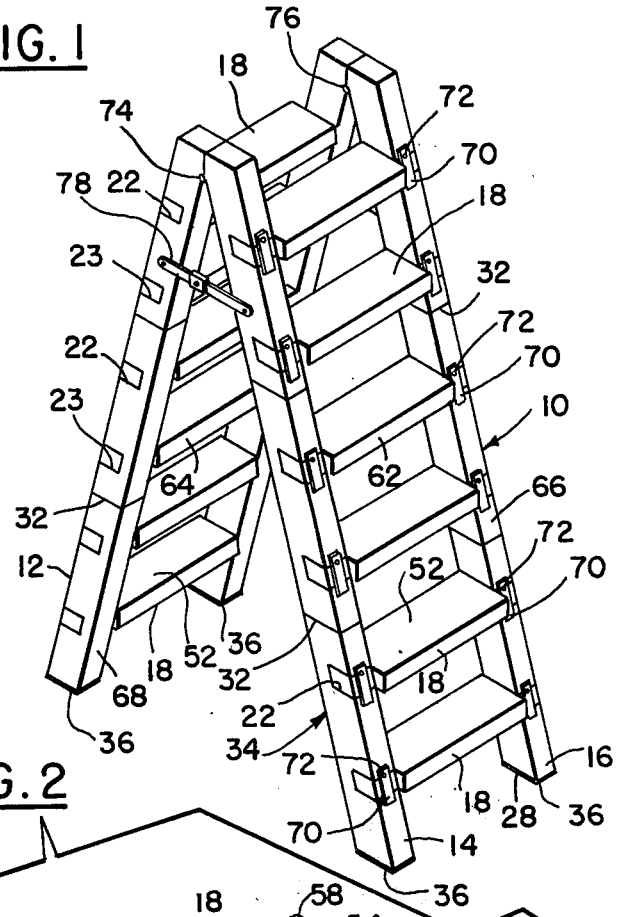
FIG. 1 is a perspective view of an assembled embodiment of the invention.

Although specific terms are used in the following description for the sake of clarity, these terms are intended to refer only to the particular structure of my invention selected for illustration in the drawings, and are not intended to define or limit the scope of the invention.

Referring now to the drawings, I show in FIG. 1 a modular ladder 10 which is comprised generally of a plurality of similar, modular, rail units 12 which are interconnected in the manner hereinafter more fully set forth to form the left and right ladder rails 14, 16. A plurality of rung units 18 interfit with the left and right rails 14, 16 in angular relation to form the vertically spaced ladder rungs.

Figure 2:
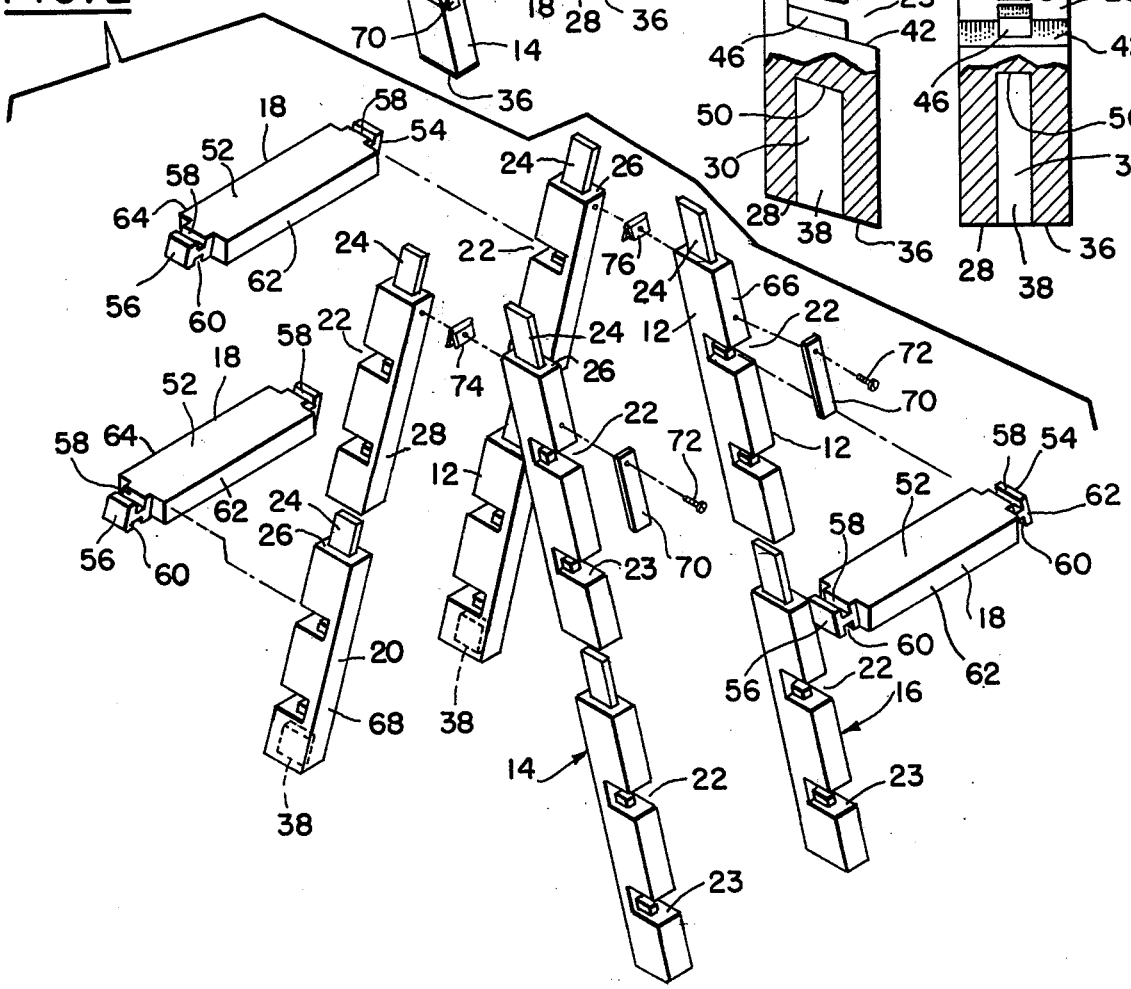
FIG. 2 is an exploded perspective view of the modular sections thereof.

Referring now to FIG. 2, I show each rail unit 12 of indentical construction and configuration comprising an elongate body section 20, which extends in length a predetermined modular distance, for example, approximately 24 to 26 inches. In this manner, by employing a convenient modular length, each rail unit 12 can be easily packaged for transportation purposes. Each body section 20 is preferably provided with at least two longitudinally spaced, recessed areas 22, 23 for reception of the rung units 18 as hereinafter more fully set forth. Each rail unit includes an end projecting strut 24 which extends upwardly from the top 26 of the body section 12 a sufficient distance to provide a rigid, strond, interconnection between longitudinally juxtaposed, interconnecting rail units 12. A strut length of approximately three to four inches has been found suitable for this purpose. The bottom 28 of each rail unit 12 is provided with a socket recess 30 of suitable dimensions to receive a projecting strut 24 therein in a relatively tight, sliding engagement. The socket recess 30 extends upwardly from the body section bottom 28 a distance equal to the height of the projecting strut 24 and is formed to substantially the same configuration to thereby form an extremely strong, mating junction with a strut 24. By constructing the strut 24 and socket recess 30 to substantially the same configuration with just sufficient clearance to provide a relatively tight, sliding engagement, the modular junctions 32 between longitudinally juxtaposed rail units 12 can be easily assembled and disassembled in the field without requiring the use of any tools whatsoever.

Inasmuch as portable ladders are almost always utilized in angular inclination from the vertical, I prefer to angularly incline each body section top 26 and bottom 28 to approximate a horizontal orientation when the ladder 10 is in use. In this manner, each bottom 28 will form a firm footing upon the ground surface 34 when the ladder 10 is in use. It is important that the angular orientation of the top 26 relative to the longitudinal axis of the rail unit 12 be equal to the angular orientation of the bottom 28 so that the various modular rail units 12 will readily interfit upon assembly as best seen in FIG. 1.

If desired, the various rail unit bottoms 28 can each be equipped with a resilient pad 36 which may be fabricated of rubber or other suitable material. Each pad 36 should be cut out as necessary to conform to the configuration of the bottom opening 38 of each socket recess 30 to thereby not interfere with the interlocking relationship between each socket recess 30 of one rail unit 12 and the projecting strut 24 of the next lower positioned rail unit when the parts are interfitted and assembled to form the various left and right rails 14, 16. The resilient pads 36 serve to buffer the various modular junctions 32 upon interconnection of the modular rail units 12. Also, the bottommost resilient pads 36, when applied directly against the ground surface 34, provide a non-skid contact between the assembled ladder 10 and the ground 34.

Each rail unit 12 is preferably provided with at least two longitudinally spaced recessed areas 22, 23 to receive a rung unit 18 therein when assembling the ladder 10. The recesses areas 22, 23 are spaced apart a longitudinal distance equal to the desired spacing between rungs when the ladder is assembled, for example, approximately ten to twelve inches. Each recessed area 22, 23 should be spaced from its respective body section top 26 and body secton bottom 28 a distance equal to approximately one half the distance between the recessed areas 22, 23 on any one rail unit 12. In this manner, when the various rail units 12 are assembled in end to end relationship, the distance between the upper recessed area 22 on one rail unit 12 and the bottom recessed area 23 of the next above positioned rail unit 12 will similarly be equal to the desired spacing between the rungs, for example, ten to twelve inches. The top and bottom boundaries 40, 42 of the recessed areas 22, 23 are preferably angularly oriented relative to the longitudinal axis of each rail unit 12 to the same angular inclination as the top 26 and bottom 28 of the body section 20 to thereby properly horizontally orient the rung units 18 when the ladder 10 is in use. Top and bottom aligning tongues 44, 46 respectively project downwardly and upwardly within the recessed areas 22, 23 to interlock with the rung units 18 for locking purposes as hereinafter more fully set forth.

Figure 3:
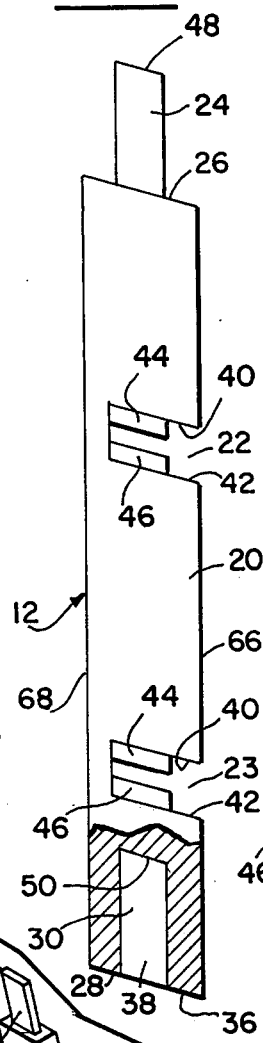
FIG. 3 is side elevational view of a modular rail section.
Figure 4:
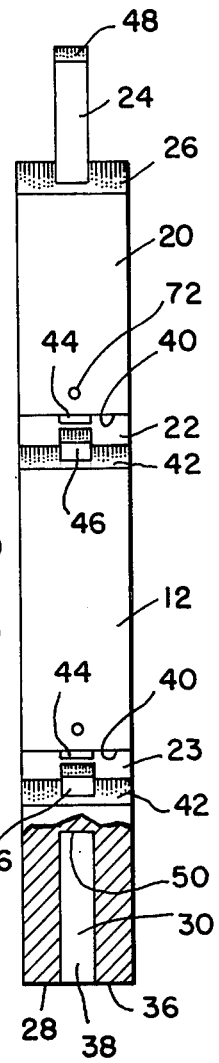
FIG. 4 is a front elevational view of the rail section of FIG. 3.

Still referring to FIGS. 3,4, it will be seen that each upwardly projecting strut 24 terminates upwardly in an inclined top edge 48 which is similarly angularly oriented with respect to the longitudinal axis of the rail unit 12 as the inclined top and bottom surfaces 26, 28 of the body section 20. Similarly, the bottom socket recess 30 terminates upwardly in an inclined roof 50 which is inclined to the same angle as the top surface 48 of the projecting strut 24 so that the top surface 48 seats against and tightly interfits with the roof 50 of the socket recess 30 when longitudinally juxtaposed rail units 12 are assembled for ladder assembly purposes. The longitudinal distance between each body section top 26 and its associated projecting strut top 48 is equal to the distance between the bottom of the resilient pad 36 and the roof 50 of the socket recess 30 to provide a tightly interfitting, rigid construction when the parts are assembled.

Each rung unit 18 is fabricated to the same width to space the left and right ladder rails 14, 16 apart a predetermined, desired distance, for example, twenty to twenty-four inches. The rug units 18 are fabricated to a suitable depth to provide satisfactory working surface 52, for example, approximately four inches in depth. Of course, the width and depth of the rung units 18 can be varied within relatively wide ranges to provide a modular ladder 10 of any desired configuration for a particular purpose. It should be remembered however that all of the rung units 18 should be similarly formed and all of the rail units 12 should also be similarly formed to thereby render the ladder 10 truly modular in design and construction. The right and left ends 54, 56 of the rung units 18 are similarly formed and are provided with upper and lower transverse grooves 58, 60 which are in vertical registry and which are configured to slidingly receive the respective top tongues 44 and bottom tongures 46 of the rail unit recessed areas 22, 23 in a relatively tight, sliding engagement. In this manner, once the various rail units 12 have been assembled to form the left and right ladder rails 14, 16, the rung units 18 can be applied by sliding each rung unit horizontally into the recessed areas 22, 23 with the respective top and bottom tongues 44, 46 engaged within the respective upper grooves 58 and lower grooves 60 at each side of each rung unit 18. Preferably, the front edge 62 and rear edge 64 of each rung unit 18 is angularly inclined from the top working surface 52 to align with the respective front and rear faces 66, 68 of the left and right ladder rails, 14, 16 upon assembly of the parts. In this manner, a finished appearing modular ladder 10 can be easily field assembled.

If desired, a pivoting type latch 70 can be provided on the front face 66 of each rail unit 12 immediately above the recessed areas 22, 23 for rung unit locking purposes. Each latch member 70 is pivotally interconnected by the pivot pin 72 in a mnner to provide a simple, pivotal lock upon proper engagement of the parts. Thus, by pivoting the latch 70 above the front of each recessed area 22, 23 the various rung units 18 can be inserted into the recessed areas 22, 23 by sliding the respective upper and lower grooves 58, 60 inwardly relative to the top and bottom tongues 44, 46 until the rung units are fully seated within the recessed areas 22, 23. In this position, the front edge 62 of each rung unit 18 aligns with the front faces 66 of the ladder rails 14,

16 and the rear edge 64 of the rung unit aligns with the rear faces 68 of a ladder rails 14, 16. When the rung units 18 are fully seated, the latches 70 can be pivoted about the pivot pins 72 relative to the left and right ladder rails 14, 16 to overfit the front edge 62 of each rung unit 18 to thereby lock the rung units into the assembled position. The modular components of the ladder 10 are then fully locked and the ladder can then be safely used on the job site. Of course, as many rail units 12 and as many rung units 18 as may be necessary to fabricate a ladder of the desired height can be employed in similar manner by simply interfitting the various projecting struts 24 into the cooperating socket recesses 30 and by introducing the rung units 18 into the various recessed areas 22, 23.

In order to assemble an A-type ladder as indicated in FIG. 1, a pair of top hinges 74, 76 should be employed in well known manner to interconnect the uppermost modular rail units 12. In this configuration, conventional split folding arm supports 78 should be employed and interconnected between the corresponding upper modular rail units 12 in conventional manner. Conventional fasteners such as bolts or sheet metal screws may be provided in the usual manner for this purpose.

Although I have described the present invention with reference to the particular embodiments therein set forth, it is understood that the present disclosure has been made only by way of example and that numerous changes in the details of construction may be resorted to without departing from the spirit and scope of the invention. Thus, the scope of the invention should not be limited by the foregoing specification, but rather only by the scope of the claims appended hereto.

I claim:

1. In a ladder construction, the combination of

A. a plurality of similar, interfitting, modular, rail units, each rail unit having a first end and a second end, 1. said rail units including longitudinally aligned means to interconnect longitudinally juxtaposed rail units, a. the longitudinally aligned means comprising a strut which projects from a first end of the rail unit, said strut engaging the second end of a longitudinally juxtaposed rail unit and a socket recess in the second end of a modular rail unit, the projecting strut of one modular rail unit being insertable through the socket recess of an adjacent modular rail unit to connect longitudinally adjacent modular rail units, 2. said rail units including recessed means to receive rung units therein, b. the recessed means being provided with tongue means to receive the said rung interconnecting means, and a plurality of rung units to connect to the rail units, 1. said rung units including interconnecting means to affix to the rail units.

2. The ladder of claim 1 wherein the interconnecting means includes an end position transverse groove, the said tongue means being in sliding engagement within the groove.

3. The ladder of claim 2 wherein the tongue means include an upper tongue depending from the top of the recess and a lower tongue projecting upwardly from the bottom of the recess, the said tongues defining a space therebetween, and a portion of the rung unit sliding into the said space.

4. The ladder of Claim 3 wherein the interconnecting means comprise an upper groove and a lower groove at each end of the rung unit, the upper tongue being received in the upper groove and the lower tongue being received in the lower groove when the rung unit is connected to the rail unit.

5. The ladder of claim 1 and locking means to lock the rung to the rail units.

6. The ladder of Claim 5 wherein the locking means connect to the rail units and are pivotally connected thereto.

7. The ladder of Claim 6 wherein the locking means are movable relative to the rail unit from a first position which is clear of the recessed means to a second position which overlies a portion of the recessed means, the locking means securing the rung unit to the rail unit when in the said second position.

* * * * *